US010443798B1

(12) United States Patent
Tan et al.

(10) Patent No.: US 10,443,798 B1
(45) Date of Patent: Oct. 15, 2019

(54) ARTIFICIAL CANDLE LAMP

(71) Applicants: Yuanjin Tan, Guizhou (CN); Wanlin Chen, Taipei (TW); Xingshu Wang, Hubei (CN)

(72) Inventors: Yuanjin Tan, Guizhou (CN); Wanlin Chen, Taipei (TW); Xingshu Wang, Hubei (CN)

( * ) Notice: Subject to any disclaimer, the term of this patent is extended or adjusted under 35 U.S.C. 154(b) by 0 days.

(21) Appl. No.: 16/175,331

(22) Filed: Oct. 30, 2018

(30) Foreign Application Priority Data

Sep. 14, 2018 (CN) ..... 2018 1 1075867

(51) Int. Cl.
*F21S 10/04* (2006.01)
*F21S 9/02* (2006.01)
*F21S 6/00* (2006.01)

(52) U.S. Cl.
CPC ..... *F21S 10/046* (2013.01); *F21S 6/001* (2013.01); *F21S 9/02* (2013.01)

(58) Field of Classification Search
CPC ..... F21S 10/04; F21S 6/001
See application file for complete search history.

(56) References Cited

U.S. PATENT DOCUMENTS 10,323,810 B2 * 6/2019 Boldsen ..... F21S 10/046
2014/0211458 A1 * 7/2014 Lai ..... F21V 35/00 362/161
2015/0233538 A1 * 8/2015 Sheng ..... F21S 10/046 362/190
2015/0308643 A1 * 10/2015 Huang ..... F21S 10/046 362/157
2016/0040843 A1 * 2/2016 Patton ..... F21S 6/001 362/362
2016/0146413 A1 * 5/2016 Wu ..... F21S 6/001 362/277
2018/0010750 A1 * 1/2018 Cheng ..... G02B 6/0006
2019/0003670 A1 * 1/2019 Angelotti ..... F21S 10/04
2019/0063703 A1 * 2/2019 Hurduc ..... F21S 10/046

FOREIGN PATENT DOCUMENTS

CN 107289417 A 10/2017

* cited by examiner

*Primary Examiner* — Julie A Bannan
(74) *Attorney, Agent, or Firm* — Muncy, Geissler, Olds & Lowe, P.C.

(57) ABSTRACT

An artificial candle lamp includes a candle body with a candlewick through hole. The candle body has an accommodating cavity communicated with the candlewick through hole. The upper part of the accommodating cavity has a shell below the candlewick through hole and the lower part thereof has a power source. A bracket is installed in the shell, an integrally formed candlewick member is erected on the bracket, a driving device is fixedly installed on the bracket, and a first light source is provided in the shell and powered by the power source. The candlewick member swings on the bracket under the combined action of its own gravity and the driving device. The candlewick member is integrally formed without additional assembly, thus eliminating the trouble of structural assembly of multiple components of the existing artificial candle lamp.

8 Claims, 4 Drawing Sheets

ARTIFICIAL CANDLE LAMP

TECHNICAL FIELD

The present invention relates to the technical field of electronic candles, and in particular, to an artificial candle lamp.

BACKGROUND

The artificial candle lamp can simulate the candlelight effect of a flame candle, can effectively avoid fire hazards and is safe to use. Therefore, the flame candle is replaced with the artificial candle lamp in numerous applications.

Simulation design is generally carried out on two parts of the candle lamp, i.e., a candleholder and a lampwick. The simulation design of the candleholder is relatively mature, but the design of the lampwick is still in a state of lower simulation degree so far. At present, the similarity between structure principles of artificial candle lamps on the market is: making the lampwick into a candlewick sheet, setting the middle of the candlewick sheet as a structure capable of freely moving around a fulcrum, then providing a magnet at the bottom of the candlewick sheet, and providing an electromagnet to produce a varying magnetic field to drive the magnet to repel amplitude variation, so as to drive the candlewick sheet to waggle, thereby simulating the effect that the lampwick freely swings with the wind.

However, the lampwick simulation structure similar to the foregoing artificial candle lamp still has many defects, for example, first, each of the internal structures of most artificial candle lamps is composed of many components, the parts are complicated, and the assembly is troublesome; secondly, during transport of the existing assembled artificial candle lamps, the parts are very likely to be separated due to waggle, and even the products are damaged, the damage rate of the finished products thus cannot be guaranteed; thirdly, because the existing artificial candle lamp simulates the candle flame to freely swing with wind, the swinging amplitude and direction of the candlewick sheet of the existing artificial candle lamp are random and uncontrollable, more space needs to be reserved to adapt to overlarge swinging amplitude of the candlewick sheet, and the swinging condition of the candle flame in breeze cannot be simulated; moreover, because the light offset is too much to improve, for example, for an artificial candle lamp of Chinese patent no. CN107289417A, the conformity of production is poor and mass production cannot be achieved, and thus the cost is higher; fourthly, the simulation degree of the existing artificial candle lamp is poor as compared with a burned candlewick; moreover, for some products, the internal structures thereof are oscillated due to the spring and the silica gel, resulting in that large deviation of light occurs during production, and mass production likewise cannot be achieved; fifthly, in an artificial candle lamp driven by an electromagnet, because the electromagnet would produce repulsive force for driving the candlewick sheet of the artificial candle lamp to waggle, continuous power supply is required and the power consumption is high; moreover, because the artificial candle lamp is generally powered by a battery, and the duration of power supply of the battery is short, the replacement frequency of battery is high, and this goes against with environment protection; and finally, the candleholder of the artificial candle lamp is entirely opaque, and the simulation degree is still low.

SUMMARY

The present invention provides an artificial candle lamp with simple structure, ease of assembly and transport, and higher simulation degree.

To solve the foregoing technical problem, the present invention adopts the following technical solution:

Provided is an artificial candle lamp, including a candle body provided with a candlewick through hole, where the candle body is provided therein with an accommodating cavity communicated with the candlewick through hole, and the upper part of the accommodating cavity is provided with a shell located below the candlewick through hole, and the lower part thereof is provided with a power source, and further including a bracket installed in the shell, an integrally fonned candlewick member erected on the bracket, a driving device fixedly installed on the bracket, and a first light source provided in the shell and powered by the power source; the candlewick member swings on the bracket under the combined action of its own gravity and the driving device.

The integrally formed candlewick member includes a lampwick portion, a connection portion, a lever portion, and a gravity portion; the lever portion is a vertically bent force arm rod; one end of the force arm rod is vertically downward and is connected to the gravity portion, and the other end thereof is connected to the lampwick portion through the connection portion; the candlewick member is erected on the bracket through the connection portion, and the candlewick member swings on the bracket under the combined action of the gravity portion and the driving device.

Furthermore, the bracket includes a pedestal installed on a bottom wall in the accommodating cavity and two parallel support rods vertically provided on the pedestal; the two support rods are respectively provided with symmetrical installing holes; the connection portion of the candlewick member is a connecting rod; the connecting rod is simultaneously connected to the force arm rod and the lampwick portion; and the bending portion of the force arm rod connected to the connecting rod is perpendicular to the lampwick portion; both ends of the connecting rod are respectively inserted in the installing holes of the two support rods.

Furthermore, both ends of the connecting rod located between two support rods are respectively provided with limiting sheets, each of the limiting sheets is provided with a bayonet; the opposite sides of the two support rods are respectively provided with limiting blocks; and the bayonets on the limiting sheets are respectively fit and clipped to the limiting blocks on the support rods.

Furthermore, the driving device includes an electromagnetic coil provided on the bracket and a PCBA board electrically connected to the power source; the PCBA board provides a magnetic field for the electromagnetic coil; the gravity portion of the candlewick member is a magnet drop hammer repelling with the magnetic field of the electromagnetic coil, and the electromagnetic coil is provided below the magnet drop hammer.

Preferably, the middle of the lower end of the lampwick portion is provided with a lampwick strip simulating a burned candle wick, the lower end of the lampwick strip extends to the connection portion, and the lampwick strip and the lampwick portion are integrally formed.

Preferably, the surface of the candle body provided with the candlewick through hole is an arc surface, and the center of the arc surface points to the exterior of the candle body.

Preferably, the lampwick portion is semitransparent, with one end being a connecting end fixed to the connection portion, and the other end being a free end; the light of the first light source is projected to the free end.

Optionally, the candle body is further provided therein with a second light source powered by the power source; the second light source is provided on an outer bottom wall of the shell, and the light of the second light source is projected to the bottom of the accommodating cavity.

Optionally, the candle body is a semitransparent candle body, and the power source is a dry battery or a rechargeable battery.

Compared with the prior art, the artificial candle lamp of the present invention is provided with a bracket in the candle body, an integrally formed candlewick member is erected on the bracket, a driving device capable of driving the candlewick member is also provided, and the candlewick member swings under the combined action of its own gravity and the driving device. Because the candlewick member is integrally formed without additional assembly, the trouble of structural assembly of multiple components of the existing artificial candle lamp is eliminated, and the defects of easy aging, wear and damage of the complicated structural assembly in use are avoided. Therefore, the artificial candle lamp of the present invention is simple in structure, quick in disassembly and assembly, and easy in overall installation. In addition, since the candlewick member of the artificial candle lamp adopts integrated solidification molding design, the component structures are fewer, thus facilitating mass production and transport, and greatly reducing the production cost; moreover, the candlewick member is driven by the downward gravity of the candlewick member and the upward pushing force of the driving device together, so that the candlewick part swings, and the simulation degree is high under the illumination of the first light source.

DETAILED DESCRIPTION

The present invention is further described below in combination with the detailed description. The accompanying drawings are merely used for exemplary description, merely represent schematic diagrams rather than diagrams of real products, and cannot be understood as limitations to the present patent. To better describe the embodiments of the present invention, some components in the accompanying drawings would be omitted, zoomed in or zoomed out, and do not represent the actual product sizes. Those skilled in the art could understand that some known structures and descriptions thereof in the accompanying drawings may be omitted.

FIGS. 1 to 7 illustrates embodiments of the artificial candle lamp of the present invention.

Figure 1:
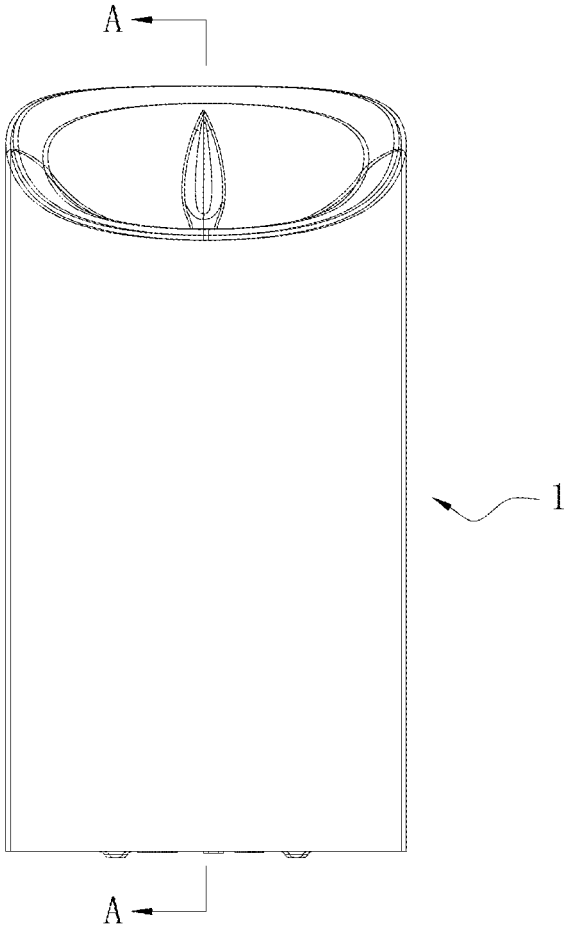
FIG. 1 is an overall structure diagram of an artificial candle lamp according to the present invention.
Figure 2:
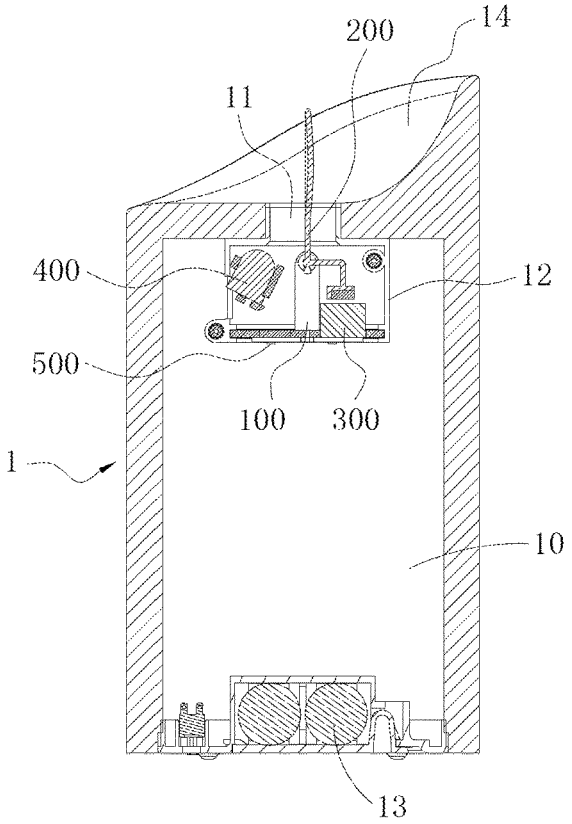
FIG. 2 is a schematic diagram of cross section A-A of FIG. 1.

As shown in FIGS. 1 and 2, the artificial candle lamp includes a candle body 1 provided with a candlewick through hole 11, where the candle body 1 is provided therein with an accommodating cavity 10 communicated with the candlewick through hole 11. The upper part of the accommodating cavity 10 is further provided with a shell 12, and the lower part thereof is provided with a power source 13; and the shell 12 is located below the candlewick through hole 11. A bracket 100 is further installed in the shell 12, an integrally formed candlewick member 200 is erected on the bracket 100 and a driving device 300 is fixedly installed on the bracket 100, and a first light source 400 powered by the power source 13 for irradiating the candlewick member 200 is further provided in the shell 12; the candlewick member 200 swings on the bracket 100 under the combined action of its own gravity and the driving device 300. The artificial candle lamp is provided with a bracket 100 in a candle body 1, a candlewick member 200 is erected on the bracket 100, a driving device 300 capable of driving the candlewick member 200 is provided, and the candlewick member 200 swings under the combined action of its own gravity and the driving device 300, and therefore, the artificial candle lamp is simple in structure, convenient for installation, and higher in simulation degree.

The artificial candle lamp of this embodiment is provided with a bracket 100 in the candle body 1, an integrally formed candlewick member 200 is erected on the bracket 100, a driving device 300 capable of driving the candlewick member is provided, and the candlewick member 200 swings under the combined action of its own gravity and the driving device 300. Because the candlewick member 200 is integrally formed without additional assembly, the trouble of structural assembly of multiple components of the existing artificial candle lamp is eliminated, and the defects of easy aging, wear and damage of the complicated structural assembly in use are avoided. Therefore, the artificial candle lamp of this embodiment is simple in structure, quick in disassembly and assembly, and easy in overall installation. In addition, since the candlewick member 200 of the artificial candle lamp adopts integrated solidification molding design, the component structures are fewer, thus facilitating mass production and transport, and greatly reducing the production cost; moreover, the candlewick member 200 is driven by the downward gravity of the candlewick member 200 and the upward pushing force of the driving device 300, so that the candlewick part of the candlewick member 200 swings, and the simulation degree is high under the illumination of the first light source.

To further illustrate the artificial candle lamp of the present invention, as shown in FIGS. 3, 5, 6, and 7, the integrally formed candlewick member 200 consists of four portions, i.e., a lampwick portion 210, a connection portion 220, a lever portion 230, and a gravity portion 240, and the four portions are integrally solidified and molded. The lever portion 230 is a vertically bent force atm rod; one end 231 of the force atiu rod is vertically downward and is connected to the gravity portion 240, and the other end 232 thereof is connected to the lampwick portion 210 through the connection portion 220; the candlewick member 200 is erected on the bracket 100 through the connection portion 220, and the candlewick member 200 swings on the bracket 100 under the combined action of the gravity portion 240 and the driving device 300. It can be understood that, to make the artificial candle lamp have a higher simulation degree, the lampwick portion 210 of the candlewick member 200 is generally made in the shape of candle flame.

Because of the integrated solidification molding design of the candlewick member 200, the artificial candle lamp is simple in structure, and the finished product is obtained by only installing a limited number of components, quick assembly and disassembly and easy of transport are achieved, the conformity of production is good, the unit costs of components are low, and mass production can be achieved. The lampwick portion 210 and the gravity portion 240 of the candlewick member 200 are connected through a vertically bent force arm rod, and the candlewick member 200 is driven by the downward gravity of the gravity portion 240 and the upward pushing force of the driving device 300 according to the lever principle, so that the candlewick part 210 swings, and the simulation degree is high under the illumination of the first light source 400.

More specifically, as shown in FIGS. 4, 5, 6, and 7, the bracket 100 includes a pedestal 110 installed on a bottom wall in the accommodating cavity 10 and two parallel support rods 120 vertically provided on the pedestal 110, and the two support rods 120 are respectively provided with symmetrical installing holes 121. The connection portion 220 of the candlewick member 200 is designed to be a simple connecting rod; the connecting rod is simultaneously connected to the force arm rod and the lampwick portion 210; and the bending portion of the force aim rod connected to the connecting rod is perpendicular to the lampwick portion 210; both ends of the connecting rod are respectively inserted in the installing holes 121 of the two support rods 120, so that the installation of the candlewick member 200 on the bracket 100, is completed, leading to great convenience.

Figure 3:
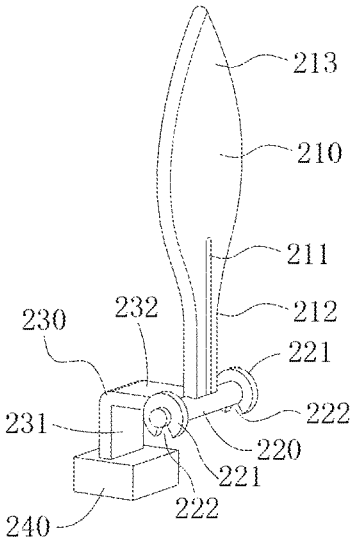
FIG. 3 is a stereogram of a candlewick member.
Figure 4:
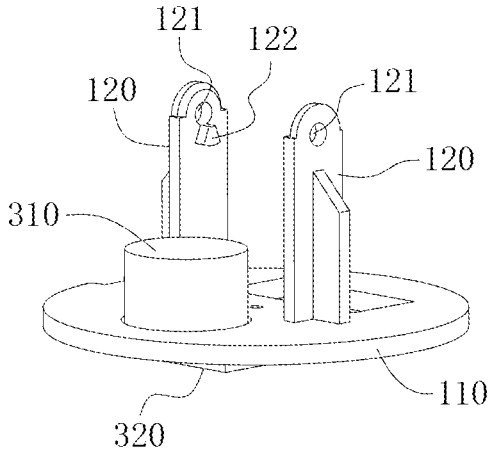
FIG. 4 is a schematic assembly diagram of the bracket and the driving device.
Figure 5:
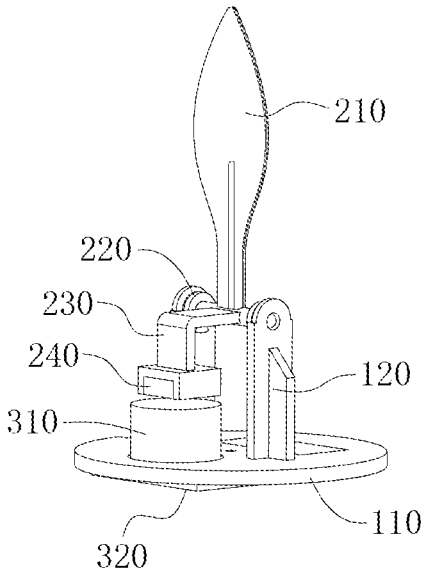
FIG. 5 is a schematic assembly diagram of the candlewick member, the bracket and the driving device.
Figure 6:
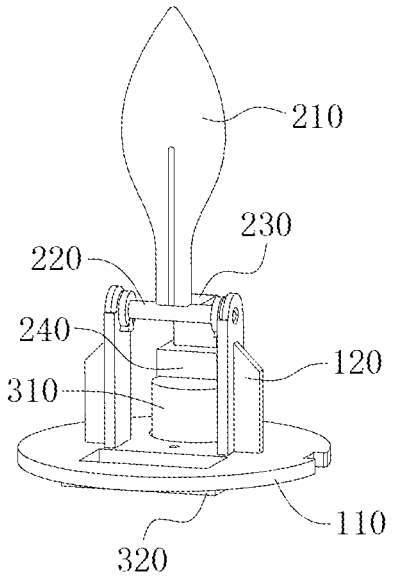
FIG. 6 is another schematic assembly diagram of the candlewick member, the bracket and the driving device.
Figure 7:
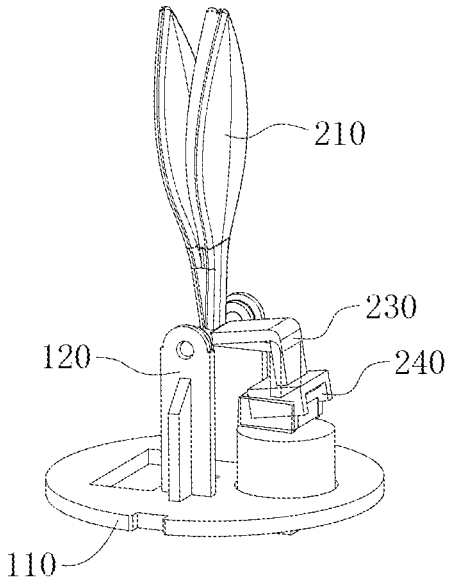
FIG. 7 is a motion state diagram of the candlewick member, the bracket and the driving device.

In addition, to reduce the product damage rate of the artificial candle lamp during transport, decrease the degree of separation of components and improve the stability of the product, both ends of the connecting rod of this embodiment located between two support rods 120 are respectively provided with limiting sheets 221; as shown in FIGS. 3 and 4, each of the limiting sheets 221 is provided with a bayonet 222; moreover, the opposite sides of the two support rods 120 are respectively provided with limiting blocks 122; and the bayonets 222 on the limiting sheets 221 are respectively fit and clipped to the limiting blocks 122 on the support rods 120. Hence, when the artificial candle lamp is moved or even turned over, i.e., no matter the artificial candle lamp is placed transversely or upside down, due to the clipping limitation of the limiting blocks 122 and the limiting sheets 221, the candlewick member 200 would not be separated from the bracket 100 in a very large range, ensuring the integrity and stability of the product, and the user can normally use the artificial candle lamp only by placing the product upright.

As shown in FIG. 4, the driving device 300 of the embodiments of the present invention includes an electromagnetic coil 310 provided on the bracket 100 and a PCBA board 320 electrically connected to the power source 13; the PCBA board 320 provides a magnetic field for the electromagnetic coil 310; the gravity portion 240 of the candlewick member 200 is a magnet drop hammer repelling with the magnetic field of the electromagnetic coil 310, and the electromagnetic coil 310 is provided below the magnet drop hammer. The candlewick member 200 produces downward power through the own weight of the magnet drop hammer by using the fixed positions of the connecting rod erected on two support rods 120 of the bracket 100 as fulcrums according to the lever principle; moreover, the electromagnetic coil 310 produces repulsive force to the magnet drop hammer through the PCBA board 320, i.e., the N pole of the electromagnetic coil 310 and the N pole of the magnet drop hammer produce a magnetic field cutting line to overcome the gravity of the candlewick member 200 so as to produce an upward motion force to cause the candlewick member 200 to swing.

It can be understood that the electromagnetic coil 310 of this embodiment can be controlled by a single chip microcomputer (IC) to intermittently provide a magnetic field; the swing amplitude and swing frequency of the candlewick member 200 are changed by controlling the current of the electromagnetic coil 310; under the action of the gravity and the magnetic repulsive force, the candlewick member 200 can swing irregularly, and thus the simulation degree is higher; moreover, the service life of the power source 13 (battery) can be prolonged by about 30%. The design enables the artificial candle lamp of this embodiment to simulate not only the effect that the lampwick of the candle swings with the wind, but also the effect that candle flame burns and flickers in a windless condition, and therefore, the artificial candle lamp is environment-friendly and safe, and low in energy consumption, and can also closely imitate combustion dynamics of the candle flame. In addition, in practical production, the size of the magnet drop hammer may be designed according to the size of the force arm rod; that is, the candlewick member 200 can obtain downward swinging force by making the magnet drop hammer having a very small weight according to the size of the force arm rod, and thus the production cost is reduced, and resource waste is decreased.

As an improvement to the foregoing embodiment, as shown in FIG. 3, the middle of the lower end of the lampwick portion 210 is provided with a lampwick strip 211 simulating a burned candle wick, the lower end of the lampwick strip 211 extends to the connection portion 220, and the lampwick strip 211 and the lampwick portion 210 are integrally formed. The lampwick strip 211 can be made into a black lampwick strip 211 (preferably, the sizes are: 10 mm long, and 2 mm width) to truly simulate the burned candle wick. Under the projection of light, a soft halo effect appears at the edge of the lampwick portion 210. Under halo and the projection of lamplight, the artificial candle lamp burns like a real candle, the simulation degree of the flame of the lampwick portion 210 is very high. When the power source 13 is turned off, due to the configuration of the lampwick strip 211, the entire artificial candle lamp likes a candle that has just been distinguished, and thus has a higher simulation degree than the artificial candle lamp in the existing market.

As shown in FIG. 2, to truly simulate a candle, the artificial candle lamp of this embodiment designs the surface of the candle body 1 provided with the candlewick through hole 11 to be an arc surface 14, and the center of the arc surface 14 points to the exterior of the candle body 1 to imitate the burned candle surface, thereby further improving the simulation degree.

The lampwick portion 210 of the artificial candle lamp of this embodiment is semitransparent; as shown in FIG. 3, one end of the lampwick portion 210 is a connecting end 212 fixed to the connection portion 220, and the other end thereof is a free end 213; the light of the first light source 400 is projected to the free end 213, or a highlight focus point region to which the light of the first light source 400 is projected is located at the center of the lampwick portion 210. Along with the swinging of the lampwick portion 210, the focus point swings up and down and fits the halo at the edge, and thus the simulation degree is very high. It is difficult to identify the authenticity of the flame even in the case of close observation. The first light source 400 can be replaced with an LED lamp, which is energy-saving and has long service life, so that the manufacturing cost of the artificial candle lamp is reduced.

To further improve the simulation degree of the artificial candle lamp of this embodiment, as shown in FIG. 2, the candle body 1 is further provided therein with a second light source 500 powered by the power source 13; the second light source 500 is provided on an outer bottom wall of the shell 12, and the light of the second light source 500 is projected to the bottom of the accommodating cavity 10. The second light source 500 may be an SMT chip LED lamp provided on a PCB board. In practical installation design, the second light source 500 can not only be directly powered by the power source 13, but also be connected to the PCBA board 320 and powered thereby to facilitate line lapping or control operations. The design can provide light projection to the candle body 1 downwardly so that the candle body 1 is transparent and bright, and thus the overall simulation degree is increased. Moreover, because the candle body 1 is transparent and bright, it can also serve as a night lamp, so that the practicability of the artificial candle lamp is improved.

In the embodiments of the present invention, the power source 1 is a semitransparent candle body, thereby facilitating light transmission to improve the simulation degree of the artificial candle lamp; the power source 13 is a dry battery or a rechargeable battery, which has long service life and is recyclable, thereby reducing the replacement frequency of the battery and contributing to environmental protection.

Obviously, the foregoing embodiments of the present invention are merely used for clearly describing examples of the present invention, rather than limiting embodiments of the present invention. On the basis of the foregoing description, those skilled in the art can also make other different types of changes or variations. It is neither necessary nor possible to describe all embodiments. Any modifications, equivalent substitutions and improvements made within the spirit and principle of the present invention should be included within the scopes of protection of the claims of the present invention.

The invention claimed is:

1. An artificial candle lamp, comprising a candle body provided with a candlewick through hole, wherein the candle body is provided therein with an accommodating cavity communicated with the candlewick through hole, and an upper part of the accommodating cavity is provided with a shell located below the candlewick through hole, and a lower part of the accommodating cavity is provided with a power source, and further comprising a bracket installed in the shell, an integrally formed candlewick member erected on the bracket, a driving device fixedly installed on the bracket, and a first light source provided in the shell and powered by the power source; the candlewick member swings on the bracket under the combined action of its own gravity and the driving device;

wherein the integrally formed candlewick member comprises a lampwick portion, a connection portion, a lever portion, and a gravity portion; the lever portion is a vertically bent force arm rod; one end of the force arm rod is vertically downward and is connected to the gravity portion, and the other end thereof is connected to the lampwick portion through the connection portion; the candlewick member is erected on the bracket through the connection portion, and the candlewick member swings on the bracket under the combined action of the gravity portion and the driving device;

wherein the bracket comprises a pedestal installed on a bottom wall in the accommodating cavity and two parallel support rods vertically provided on the pedestal; the two support rods are respectively provided with symmetrical installing holes;

the connection portion of the candlewick member is a connecting rod; the connecting rod is simultaneously connected to the force arm rod and the lampwick portion; and the bending portion of the force arm rod connected to the connecting rod is perpendicular to the lampwick portion; and both ends of the connecting rod are respectively inserted in the installing holes of the two support rods.

2. The artificial candle lamp according to claim 1, wherein the both ends of the connecting rod located between two support rods are respectively provided with limiting sheets, each of the limiting sheets is provided with a bayonet; opposite sides of the two support rods are respectively provided with limiting blocks; and the bayonets on the limiting sheets are respectively fit and clipped to the limiting blocks on the support rods.

3. The artificial candle lamp according to claim 1, wherein the driving device comprises an electromagnetic coil provided on the bracket and a PCBA board electrically connected to the power source; the PCBA board provides a magnetic field for the electromagnetic coil;

the gravity portion of the candlewick member is a magnet drop hammer repelling with the magnetic field of the electromagnetic coil, and the electromagnetic coil is provided below the magnet drop hammer.

4. The artificial candle lamp according to claim 1, wherein a middle of a lower end of the lampwick portion is provided with a lampwick strip simulating a burned candle wick, a lower end of the lampwick strip extends to the connection portion, and the lampwick strip and the lampwick portion are integrally formed.

5. The artificial candle lamp according to claim 4, wherein the surface of the candle body provided with the candlewick through hole is an arc surface, and a center of the arc surface points to an exterior of the candle body.

6. The artificial candle lamp according to claim 1, wherein the lampwick portion is semitransparent, with one end being a connecting end fixed to the connection portion, and the other end being a free end; the light of the first light source is projected to the free end.

7. The artificial candle lamp according to claim 1, wherein the candle body is further provided therein with a second light source powered by the power source; the second light source is provided on an outer bottom wall of the shell, and the light of the second light source is projected to a bottom of the accommodating cavity.

8. The artificial candle lamp according to claim 7, wherein the candle body is a semitransparent candle body, and the power source is a dry battery or a rechargeable battery.

* * * * *